US005379921A

United States Patent [19]

Divall

[11] Patent Number: 5,379,921

[45] Date of Patent: Jan. 10, 1995

[54] NOZZLE AND VALVE ASSEMBLY

[75] Inventor: John E. Divall, Wantage, United Kingdom

[73] Assignee: Odin Developments Limited, United Kingdom

[21] Appl. No.: 977,513

[22] Filed: May 19, 1992

[30] Foreign Application Priority Data

May 24, 1991 [GB] United Kingdom ..... 9111266

[51] Int. Cl.[6] ..... B62d 1/08

[52] U.S. Cl. ..... 222/148; 141/90

[58] Field of Search ..... 222/1, 145, 148, 149, 222/151, 380, 501, 504, 559; 239/112, 113; 141/90, 91; 137/240

[56] References Cited

U.S. PATENT DOCUMENTS

| | | | |
|---|---|---|---|
| 3,132,808 | 5/1964 | Ott | 239/112 |
| 3,498,508 | 3/1970 | Francisoud | 141/90 |
| 3,715,058 | 2/1973 | Clymans | 222/148 |
| 4,350,187 | 9/1982 | Trussell et al. | 222/148 |
| 4,460,025 | 7/1984 | Scholle et al. | 222/148 |

FOREIGN PATENT DOCUMENTS

| | | |
|---|---|---|
| 1484763 | 9/1977 | United Kingdom . |
| 2089440 | 12/1980 | United Kingdom . |

*Primary Examiner*—Andres Kashnikow
*Assistant Examiner*—Philippe Derakshani
*Attorney, Agent, or Firm*—Diller, Ramik & Wight

[57] ABSTRACT

A nozzle and valve assembly comprises a cylinder having an open end and a piston having a conical deflecting surface on its lower end. A first supply pipe is connected to the interior of cylinder through an aperture in its wall. A second supply pipe is connected through a bore formed in the wall of the cylinder to an inwardly directed orifice positioned at the bottom of the cylinder. In use, with the piston in a raised position, a solid product is supplied through the first supply pipe and discharged through the open end of the cylinder into a container. The piston is lowered, thereby closing off the aperture in its wall and hence the first supply pipe, until its lower end is level with the inwardly directed orifice. Liquid is then supplied through the second supply pipe. The liquid washes away any solid on the conical deflecting surface and is formed by the conical deflecting surface into a smooth slow flowing column of liquid.

9 Claims, 4 Drawing Sheets

NOZZLE AND VALVE ASSEMBLY

BACKGROUND OF THE INVENTION

This invention relates to a nozzle and valve assembly for supplying a product to each one of a series of containers.

In the packaging industry, there is a general requirement for a device which is capable of supplying a predetermined amount of a product to each one of a series of containers. The product may be a mixture of a particulate solid product and a liquid. After a predetermined amount of product has been supplied to a container, there is the requirement for the device to provide a clean cut off of the supply of the product without supplying any extra product until supply is recommenced for supplying the next container.

SUMMARY OF THE INVENTION

It is an object of this invention to provide a nozzle for use in supplying predetermined amounts of a product and which meets the requirements set out above.

According to this invention, there is provided a nozzle and valve assembly comprising a cylinder having an open end, a first inlet leading into the interior of the cylinder, a second inlet, a piston having a free end and mounted for reciprocating movement in the cylinder at least between a first position and a second position, the piston permitting communication between the first inlet and the open end of the cylinder when the piston is in the first position, said free end of the piston moving past the first inlet as the piston moves from the first position to the second position so as to prevent communication between the first inlet and said open end of the cylinder, a fluid deflecting surface formed on said free end of the piston, means for directing fluid from the periphery of the fluid deflecting surface inwardly and on to the fluid deflecting surface when the piston is in the second position, and means for connecting the second inlet with the fluid directing means.

BRIEF DESCRIPTION OF THE DRAWINGS

This invention will now be described in more detail, by way of example, with reference to the drawings in which.

DETAILED DESCRIPTION OF THE PREFERRED EMBODIMENT

Figure 1:
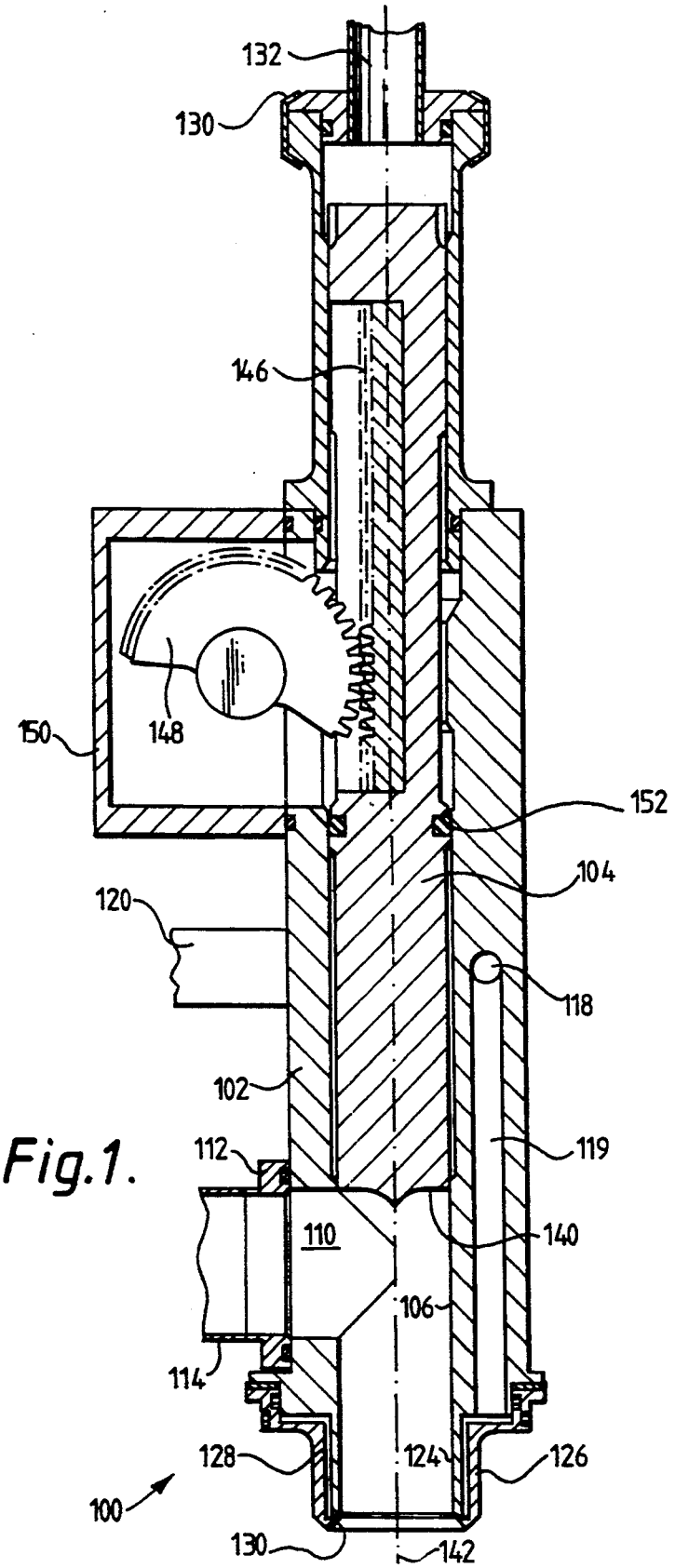
FIG. 1 is a longitudinal sectional view of a nozzle and valve assembly embodying this invention and showing the assembly in a state for supplying a solid product.
Figure 2:
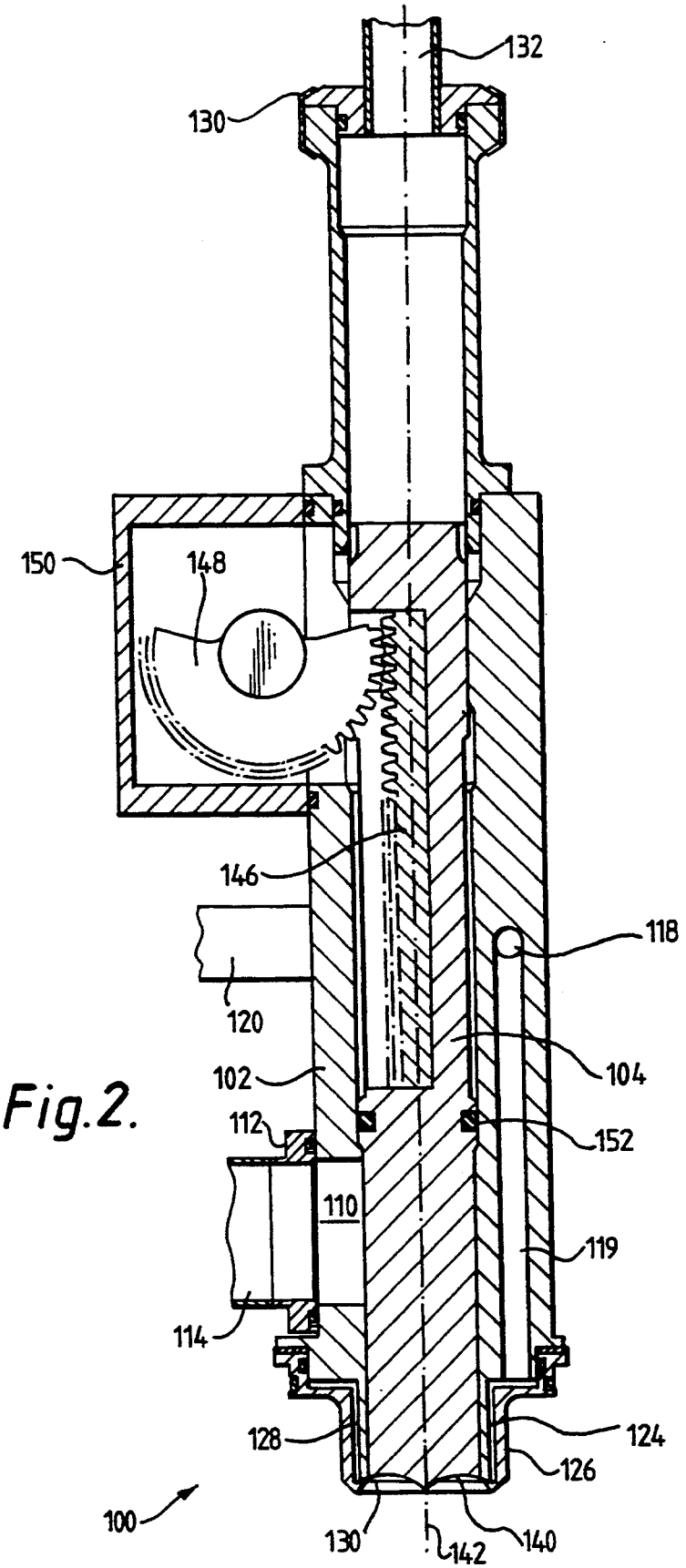
FIG. 2 is a longitudinal sectional view of the nozzle and valve assembly of FIG. 1 showing the assembly in a state for supplying a liquid product.
Figure 3:
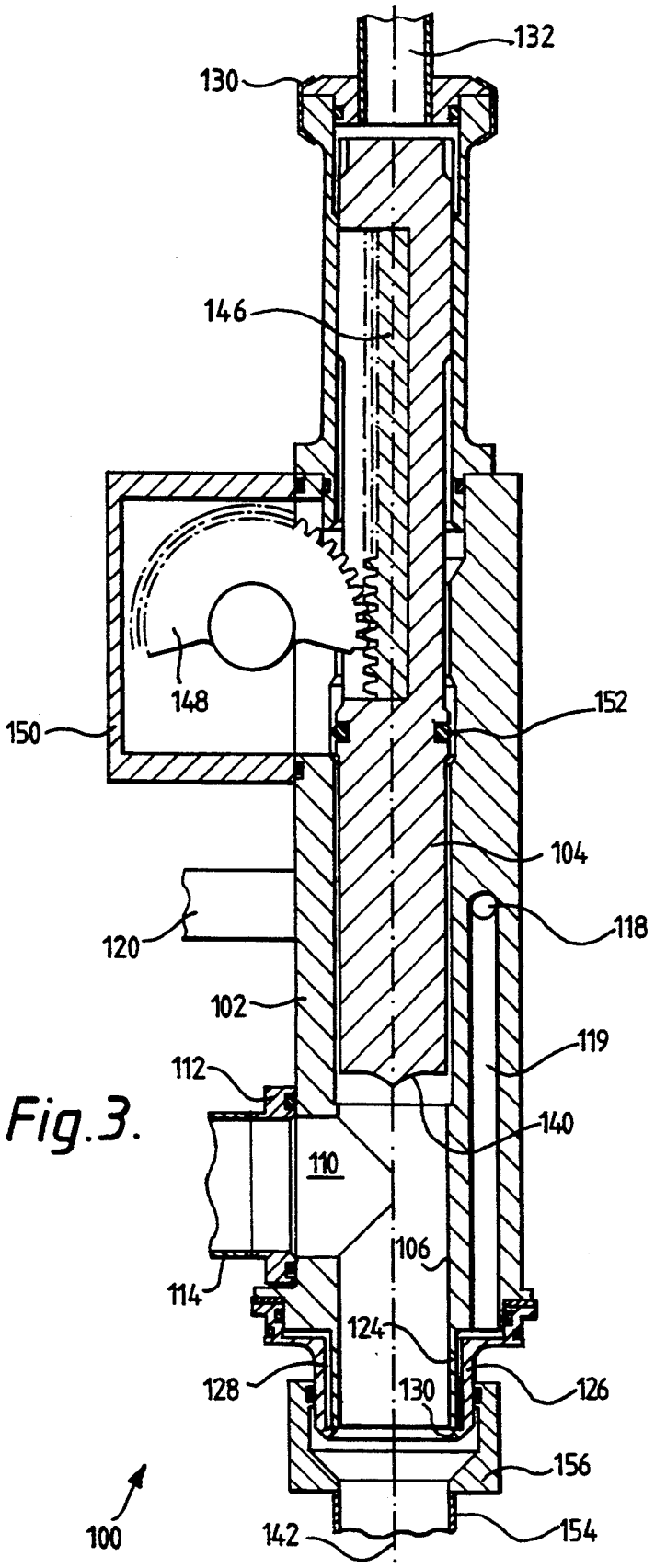
FIG. 3 is a longitudinal sectional view of the nozzle and valve assembly of FIG. 1 showing the assembly in a state in which it may be sterilized.

Referring now to FIGS. 1 to 3, there is shown a nozzle and valve assembly 100 for supplying a predetermined amount of a particulate solid product followed by a predetermined amount of a liquid product to each one of a series of containers. The containers may be, for example, metal cans, plastic pots, paperboard cartons or glass jars.

The particulate solid product may be, for example, a food product such as, suitably sized, whole sliced or diced vegetables and pieces of meat in the form of a stew, or various fruits in a compote. In this case, the liquid product will be a liquid which is suitable for combining with the solid food product. The particulate solid product may also be a non-food product. The nozzle and valve assembly 100 may also be used to supply a particulate solid product on its own.

Where the nozzle and valve assembly 100 is used to supply a food product, the food product may be supplied to the containers after sterilization. Alternatively, the product may be supplied before sterilization and, in this case, the product may then be sterilized in the containers after they have been sealed.

The nozzle and valve assembly 100 includes a cylinder 102 and a piston 104 mounted for reciprocating movement in cylinder 102. The cylinder 102 has a cylindrical bore 106 and the lower end of cylinder 102 is open.

An aperture 110 is formed in the wall of cylinder 102 towards its lower end. The opening 110 serves as a first inlet and this inlet receives, in use, a solid particulate product. On the outside of cylinder 102, there is provided a coupling member 112 for connecting the aperture 110 to a supply pipe 114.

Above the aperture 110 and at the rear of the cylinder 102 as shown in FIG. 1, a second aperture 118 is formed in the wall of cylinder 102. This aperture 118 provides a second inlet which receives a fluid in the form of a liquid product or a gas. On the outside of cylinder 102, aperture 118 is connected with a supply pipe 120. The aperture 118 is also connected to an internal bore 119 which leads from aperture 118 towards the bottom of cylinder 102.

The lower end of cylinder 102 terminates with a thin walled annular section 124. The annular section 124 is enclosed within an annular end member 126. The external surface of the annular section 124 and the internal surface of the annular end member 126 together define an axially extending annular passage 128 and an inwardly directed annular orifice 130. The annular passage 128 is in communication with the bore 119. As will be explained later, the orifice 130 directs fluid inwardly.

At its upper end, the cylinder 102 is closed by a cover 130 which receives a supply pipe 132. When the assembly 100 is used to supply a sterilized product, sterile air is supplied through pipe 132 so as to keep the interior of the assembly in a sterile condition.

On the free end of the piston 104, there is formed a deflecting surface 140. The deflecting surface 140 is conical and concave and is symmetrical with respect to a central axis 142.

The piston 104 is provided with a rack 146 which engages a semi-circular gear wheel 148 mounted on a housing 150. The gear wheel 148 is rotated by a motor or other actuator, not shown, thereby causing the piston 104 to reciprocate within cylinder 102.

Beneath the rack 146, an annular seal 152 is received in a groove formed in piston 104.

Referring now specifically to FIG. 1, the assembly 100 is shown in a state for supplying a predetermined amount of particulate solid product to a container. In this state, the piston 104 is raised into a first position so that its free end is level with the top of aperture 110. This permits solid food product to flow from supply pipe 114 through bore 106 and to be discharged through the open end of cylinder 102. As the solid food product passes the free end of piston 104, a portion of it may adhere to this free end. As the deflecting surface 140 on the free end is conical and concave, it approximates to the form that sticky solids would naturally take up on the end of a piston. Consequently, the mass of solids which actually adhere to the free end of the piston will be minimal.

After the predetermined amount of the solid product has been supplied to the container, the piston 104 descends, thereby closing off the inlet 110, until it reaches its Second position as shown in FIG. 2. In this second position, the free end of piston 104 is level with the bottom end of the annular section 124 of cylinder 102. When the piston 104 is in this second position, the assembly 100 is in a state for supplying liquid to the container.

With the piston 104 in the position shown in FIG. 2, a predetermined amount of liquid may be supplied under pressure from a metering valve through supply pipe 120. The liquid passes through the aperture 118, bore 119, annular passage 128 and orifice 130. The orifice 130 directs the liquid inwardly and onto the fluid deflecting surface 140. The deflecting surface 140 progressively deflects the liquid downwardly so as to form it into a smooth slow flowing column of liquid. Because the liquid is formed into a column in this manner, air entrainment is avoided. When a predetermined amount of liquid has been supplied, liquid is prevented from flowing through the orifice 130 by surface tension. Thus, a clean cut-off is obtained and no drips of liquid fall from the assembly 100 between containers. As the liquid passes over the fluid deflecting surface 140, it washes away any solid product which has adhered thereto.

Where it is desired to supply a relatively large amount of liquid to each container, some of the liquid may be supplied while the piston 104 is in the raised position as shown in FIG. 1.

The assembly shown in FIGS. 1 to 3 is also suitable for supplying only a predetermined amount of a particulate solid product to each container and without the supply of any liquid product. Where solid product only is to be supplied, the supply pipe 120 is connected through a valve to a source of a gas. The gas may be, for example, air, steam or nitrogen. Then, when the valve 104 is in the lower position shown in FIG. 2, the valve is opened for a short period with the result that the gas is directed on to the fluid deflecting surface 140 and thereby blows any solids which have adhered thereto downwards into a container.

When the assembly 100 is not supplying either a particulate solid product or a liquid product, the piston 104 may be retracted slightly upwardly from the position shown in FIG. 2.

FIG. 3 shows the position adopted by the piston 104 when it is desired to clean the assembly. In this position, the seal 152 is raised above the bottom of housing 150. In order to sterilize the assembly, a sterilizing fluid, such as steam, is supplied to the supply pipes 114, 120 and 132. As may be observed, sterilizing fluid from the supply pipe 132 can pass through the upper part of cylinder 102 and into the interior of housing 150. It can also flow past the seal 152 and the outer surface of the lower part of piston 104 so that it is discharged through the open end of cylinder 102. During cleaning, a return pipe 154 for the cleaning fluids is connected to the lower end of the cylinder 102 by a coupling member 156. During sterilisation by steam, the coupling member 156 includes a valve for containing pressure.

Figure 4:
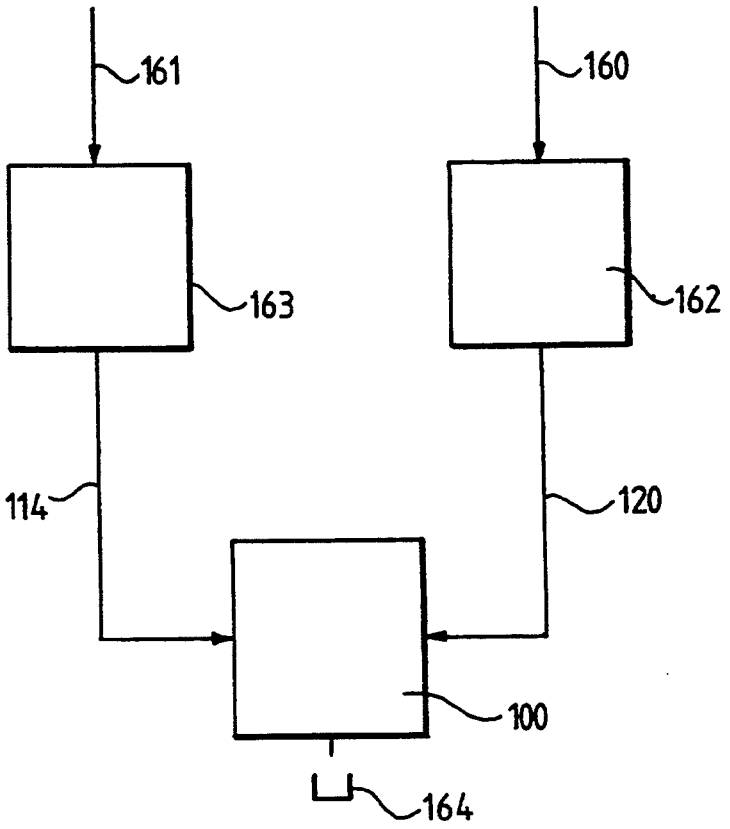
FIG. 4 is a block diagram of the nozzle and valve assembly of FIG. 1 connected to a supply pipe for a solid product and a metering valve for a liquid product.

Referring now to FIG. 4, there is shown a block diagram of the assembly 100 together with a supply pipe 161 for a particulate solid product and a supply pipe 160 for a liquid product. The supply pipes 160,161 are connected through respective metering valves 162,163 to the supply pipes 120,114. In FIG. 4, the assembly 100 is shown supplying products to a container 164.

By way of example, the metering valves 162,163 of FIG. 4 may take the form shown in published European patent application EP-A-0 280 537 or my co-pending U.S. patent application Ser. No. 07/809,589.

I claim:

1. A nozzle and valve assembly comprising a cylinder having an open end, a first inlet leading into the interior of the cylinder, a second inlet, a piston having a free end and being mounted for reciprocating movement in the cylinder at least between a first position and a second position, the piston permitting communication between the first inlet and the open end of the cylinder when the piston is in the first position, said free end of the piston moving past the first inlet as the piston moves from the first position to the second position so as to prevent communication between the first inlet and said open end of the cylinder, a fluid deflecting surface portion formed on said free end of the piston and converging in a direction towards said open end, means on the cylinder in the region of said open end for directing fluid inwardly and on to the fluid deflecting surface portion when the piston is in the second position, and means for connecting the second inlet with the fluid directing means.

2. A nozzle and valve assembly as claimed in claim 1, in which the fluid deflecting surface portion provided on said free end of the piston is conical and concave.

3. A nozzle and valve assembly as claimed in claim 1, in which the fluid directing means includes an inwardly directed annular orifice which is arranged to direct fluid onto the fluid deflecting surface portion when the piston is in the second position.

4. A nozzle and valve assembly as claimed in claim 1, in which said free end of the piston is adjacent said open end of the cylinder when the piston is in the second position.

5. A nozzle and valve assembly according to claim 1, and further comprising a rack provided on and along said piston and spaced from said first inlet in a direction away from said open end of said cylinder, and a pinion drivingly engaging said rack and mounted in a housing the interior of which communicates directly with the interior of said cylinder.

6. A nozzle and valve assembly according to claim 5 and further comprising means for introducing a cleaning fluid into the interior of said cylinder and the interior of said housing.

7. A method of supplying a particulate product and a liquid to a container, said method comprising the steps of:

a) providing a nozzle and a valve assembly comprising a cylinder having an open end, a first inlet leading into the interior of the cylinder, a second inlet, a piston having a free end and being mounted for reciprocating movement in the cylinder at least between a first position and a second position, the piston permitting communication between the first inlet and the open end of the cylinder when the piston is in the first position, said free end of the piston moving past the first inlet as the piston moves from the first position to the second position so as to prevent communication between the first inlet and said open end of the cylinder, a liquid deflecting surface portion formed on said free end of the piston, means on the cylinder in the region of said open end for directing liquid inwardly and on to the liquid deflecting surface portion when the piston is in the second position, and means for connecting the second inlet with the liquid directing means;

b) positioning a container beneath the open end of the cylinder;

c) supplying a particulate solid product to the first inlet and a liquid to the second inlet when the piston is in the first position;

d) moving the piston from the first position to the second position after amounts of the particulate solid product and the liquid have been supplied to the container; and e) supplying the liquid to the second inlet with the piston still in the second position.

8. A method as claimed in claim 7, in which the particulate product is a food product.

9. A method as claimed in claim 7, in which the fluid is a gas.

* * * * *